US008991931B2

(12) United States Patent
Narita et al.

(10) Patent No.: US 8,991,931 B2
(45) Date of Patent: Mar. 31, 2015

(54) FURNITURE CLOTH AND CHAIR

(75) Inventors: Tetsuya Narita, Yokohama (JP); Ryou Igarashi, Yokohama (JP)

(73) Assignee: Okamura Corporation, Yokohama-Shi, Kanagawa (JP)

( * ) Notice: Subject to any disclaimer, the term of this patent is extended or adjusted under 35 U.S.C. 154(b) by 142 days.

(21) Appl. No.: 13/703,310

(22) PCT Filed: Jun. 8, 2011

(86) PCT No.: PCT/JP2011/063131

§ 371 (c)(1),
(2), (4) Date: Dec. 10, 2012

(87) PCT Pub. No.: WO2011/155525

PCT Pub. Date: Dec. 15, 2011

(65) Prior Publication Data

US 2013/0088065 A1 Apr. 11, 2013

(30) Foreign Application Priority Data

Jun. 11, 2010 (JP) ..... 2010-133795
Jun. 11, 2010 (JP) ..... 2010-133796
Jun. 11, 2010 (JP) ..... 2010-133797

(51) Int. Cl.
*A47C 7/02* (2006.01)
*D03D 15/00* (2006.01)
*A47C 7/30* (2006.01)
(Continued)

(52) U.S. Cl.
CPC ..... *D03D 15/0077* (2013.01); *A47C 7/30* (2013.01); *D03D 13/006* (2013.01); *D03D 15/08* (2013.01); *A47C 7/02* (2013.01); *D03D 13/008* (2013.01); *A47C 7/282* (2013.01); *D10B 2505/08* (2013.01); *A47C 7/40* (2013.01)
USPC ..... 297/452.1; 297/452.13; 297/452.56; 297/452.64

(58) Field of Classification Search
USPC ..... 297/452.1, 452.13, 452.56, 452.64
See application file for complete search history.

(56) References Cited

U.S. PATENT DOCUMENTS 2,059,597 A * 11/1936 Okano ..... 297/452.43
3,679,261 A * 7/1972 Slabakov ..... 297/230.11
(Continued)

FOREIGN PATENT DOCUMENTS

CN 86206222 U 4/1987
CN 1612704 A 5/2005
(Continued)

OTHER PUBLICATIONS

Extended European Search Report issued in European Application No. 11 79 2482.9-1653 dated Feb. 28, 2014.
(Continued)

*Primary Examiner* — Syed A Islam
(74) *Attorney, Agent, or Firm* — McDermott Will & Emery LLP

(57) ABSTRACT

Plural weft fascia portions wider than wefts are arranged in a ground texture formed in a lattice shape by warps and the wefts so as to be spaced from each other from one end of the clothing fabric toward the other end thereof in the vertical direction, and the arrangement intervals between the weft fascia portions adjacent to each other in the vertical direction are gradually decreased from one end of the clothing fabric toward the other end in the vertical direction, and then are gradually increased from the minimum portion.

12 Claims, 7 Drawing Sheets

(51) Int. Cl.

| | |
|---|---|
| ***D03D 13/00*** | (2006.01) |
| ***D03D 15/08*** | (2006.01) |
| ***A47C 7/28*** | (2006.01) |
| *A47C 7/40* | (2006.01) |

(56) References Cited

U.S. PATENT DOCUMENTS

| | | | | | |
|---|---|---|---|---|---|
| 6,102,482 | A | * | 8/2000 | Dettoni et al. | 297/452.56 |
| 2011/0204694 | A1 | | 8/2011 | Igarashi et al. | |

FOREIGN PATENT DOCUMENTS

| | | | | | |
|---|---|---|---|---|---|
| CN | 2792862 | Y | | 7/2006 | |
| CN | 201445168 | U | | 5/2010 | |
| JP | 1-041320 | Y2 | | 12/1989 | |
| JP | 2003-135200 | A | | 5/2003 | |
| JP | 2004-033542 | A | | 2/2004 | |
| JP | 2004033542 | A | * | 2/2004 | 297/452.1 |
| JP | 2005-160558 | A | | 6/2005 | |
| JP | 2006-094995 | A | | 4/2006 | |
| JP | 2009-112360 | A | | 5/2009 | |
| JP | 2009-292426 | A | | 12/2009 | |
| WO | 2010/050204 | A1 | | 5/2010 | |

OTHER PUBLICATIONS

International Search Report issued in International Application No. {CT/JP2011/063131 issued on Jul. 19, 2011.

* cited by examiner

FURNITURE CLOTH AND CHAIR

RELATED APPLICATIONS

This application is the U.S. National Phase under 35U.S.C. §371of International Application No. PCT/JP2011/063131, filed on Jun. 8, 2011, which in turn claims the benefit of Japanese Application Nos. 2010-133795, 2010-133796, filed on Jun. 11,2010, the disclosures of which Applications are incorporated by reference herein.

FIELD

The present invention relates to a furniture cloth, which is applied to a blindfold member for panel or a load support member for chair such as an upholstery fabric stretched over a backrest or a seat body of a chair, and to a chair formed by stretching an upholstery fabric supporting a load of a back or a lower body of a human body over a rim-shaped frame of a backrest or a seat body.

BACKGROUND

There is known a configuration in a chair, for example, in which a surface contacting a human body of a seater in a seated state, i.e., a backrest surface of a backrest or a seat surface of a seat body supporting the human body is formed by stretching an upholstery fabric formed by an elastic cloth of which a ground texture is composed by knitting or weaving in a mesh shape (for example, see Patent Literatures 1 and 2).

Such an upholstery fabric may obtain seating comfort and appropriate breathability, for example, when a backward curved amount caused by a load of a human body when a seater leans against the backrest is set to be large at the upper portion supporting an upper portion of a back compared to the lower portion supporting a lower portion of the back.

However, in the backrest of the chair disclosed in Patent Literature 1, since the meshed upholstery fabric having a uniform density as a whole is stretched over the rim-shaped backrest frame, when the lower portion of the upholstery fabric is set to an appropriate curved amount, the upper portion is curved backward too much. On the contrary, when the upper portion of the upholstery fabric is set to an appropriate curved amount, the lower portion is curved too much. Due to these problems, the seating comfort may not be obtained in any case.

Further, in the backrest disclosed in Patent Literature 2, on the entire surface of the clothing fabric constituting the upholstery fabric (the backrest seat body), band-shaped meshed portions (low elastic portions) in the left and right direction and the clothing fabrics are alternately arranged in the up and down direction, i.e., woven in a plurality of steps in the up and down direction. Thus, the entire curved amount of the upholstery fabric is substantially uniform, and the seating comfort may not be improved by setting the backward curved amount of the upper portion to be larger than that of the lower portion.

Furthermore, the upholstery fabric is formed by composing long yarns in a mesh shape, and the elastic deformation force thereof is uniform in any portion of the entire surface of the cloth. For this reason, when the upholstery fabric is applied to, for example, the backrest surface of the backrest and the seat surface of the seat body of the chair, a desirable sensation of seating in response to the respective portions of the human body may not be obtained because the support strengths required for the loads of the back of the seater, the seated portion, and the leg contact portion are different from each other.

In order to solve such problems, there is known a chair, which has been filed by the present applicant and published already, in which an upholstery fabric of a backrest applies a strong elastic resistance to a seater's waist portion where a strong support force is required (Patent Literature 3).

In the upholstery fabric which is stretched over the backrest of the chair disclosed in Patent Literature 3, the elastic cloth is completely divided into two parts, i.e., a meshed ground texture and a fascia portion denser than the ground texture. The fascia portion is used for a portion corresponding to the seater's waist portion where a strong support force is required, and the ground texture is used for the other portions.

CITATION LIST

Patent Literature

Patent Literature 1: Japanese Patent Application Laid-open No. 2003-135200

Patent Literature 2: Japanese Patent Application Laid-open No. 2006-094995

Patent Literature 3: Japanese Patent Application Laid-open No. 2009-112360

SUMMARY

Technical Problem

However, in the upholstery fabric disclosed in Patent Literature 3, since the meshed ground texture and the fascia portion denser than the ground texture are adjacent to each other, the seater feels an extremely large difference in the elastic support force at the boundary portion between the ground texture and the fascia portion in the portion corresponding to the vicinity of the waist portion, and hence may not obtain the seating comfort.

Further, when the elastic cloth is applied as a blindfold member for panel, since a difference in permeability between the ground texture and the fascia portion is large, the portion of the blinded panel is seen when changing the viewing angle with respect to the panel, and hence a problem arises in that the blinding effect may not be appropriately exhibited.

For the foregoing reasons, there is a need for furniture cloth capable of obtaining seating comfort when the furniture cloth is applied as a load support member for chair and appropriately exhibiting a blinding effect when the furniture cloth is applied as a blindfold member for panel and for a chair capable of obtaining a strong elastic support force in a necessary portion without extremely differentiating an elastic support force of an upholstery fabric stretched over a backrest or a seat body for each portion with respect to a load of a back or a lower body of a human body of a seater.

According to the present invention, there is provided a furniture cloth that is formed by a clothing fabric of a ground texture which is composed in a lattice shape by warps and wefts respectively formed by a plurality of vertical yarns or horizontal yarns having at least one of single yarns or thick twisted yarns, wherein a plurality of weft fascia portions wider than the wefts are arranged in the ground texture so as to be spaced from each other from one end of the clothing fabric toward the other end in the vertical direction, and the arrangement intervals between the weft fascia portions adjacent to each other in the vertical direction are first gradually decreased from one end of the clothing fabric toward the other end in the vertical direction and then are gradually increased from a minimum portion toward the other end.

According to the present invention, in the invention described above, the arrangement intervals between the weft fascia portions are first gradually decreased as it goes from one end of the clothing fabric toward the other end in the vertical direction by increasing the number of the thick horizontal yarns constituting the weft fascia portion and widening the width of the weft fascia portion, and then are gradually increased by decreasing the number of the thick horizontal yarns from the minimum portion and narrowing the width of the weft fascia portion.

According to the present invention, in the invention described above, the arrangement intervals between the weft fascia portions are first gradually decreased from one end of the clothing fabric toward the other end in the vertical direction by decreasing the number of grains of the ground texture between the adjacent weft fascia portions, and then are gradually increased toward the other end by increasing the number of grains from the minimum portion.

According to the present invention, in the invention described above, a pattern of an arrangement shape formed by the plurality of weft fascia portions is continuously repeated at least once or more in the vertical direction of the clothing fabric.

According to the present invention, there is provided a chair which is formed by stretching the furniture cloth according to the above invention as an upholstery fabric over a rim-shaped frame in a backrest or a seat body.

According to the present invention, in the invention described above, the furniture cloth is stretched over the frame of the backrest or the seat body so that the arrangement intervals between the weft fascia portions are gradually decreased as it goes inward from the upper and lower ends of the backrest or the front and rear ends of the seat body.

According to the present invention, in the invention described above, the arrangement intervals between the weft fascia portions are decreased by gradually increasing the number of the thick horizontal yarns constituting the weft fascia portion as it goes inward from the upper and lower ends of the backrest or the front end rear ends of the seat body and widening the width of the weft fascia portion.

According to the present invention, in the invention described above, the vicinity of a portion where the arrangement interval between the weft fascia portions becomes minimal is formed as a support portion for a waist portion or a seated portion of a seater.

According to the present invention, there is provided a chair which is formed by stretching an upholstery fabric over a rim-shaped frame in a backrest or a seat body, wherein a plurality of strip-shaped step portions extending in the left and right direction so as to protrude from a surface of the upholstery fabric are arranged so as to be spaced from each other in the longitudinal direction corresponding to the front and rear direction of the seat body or the up and down direction of the backrest, and the arrangement intervals between the adjacent strip-shaped step portions are formed so as to be gradually decreased as it goes inward from the upper and lower ends of the backrest or the front and rear ends of the seat body.

According to the present invention, in the invention described above, the upholstery fabric is formed by an elastic cloth obtained from a clothing fabric of a ground texture which is composed in a lattice shape by warps and wefts respectively formed by a plurality of vertical yarns or horizontal yarns having at least one of single yarns or thick twisted yarns, and weft fascia portions wider than the wefts are composed in the ground texture so as to protrude from a surface of the upholstery fabric, thereby forming strip-shaped step portions with the weft fascia portions.

According to the present invention, in the invention described above, the arrangement intervals between the strip-shaped step portions are gradually decreased as it goes inward from the upper and lower ends of the backrest or the front and rear ends of the seat body by gradually increasing the number of thick horizontal yarns constituting the weft fascia portions and widening the width of the weft fascia portion.

According to the present invention, in the invention described above, the vicinity of a portion where the arrangement interval between the strip-shaped step portions becomes minimal is formed as a support portion for a waist portion or a seated portion of a seater.

Advantageous Effects of Invention

In the furniture cloth according to the invention, the plurality of weft fascia portions wider than the wefts are arranged so as to be spaced from each other from one end of the clothing fabric toward the other end thereof in the vertical direction in the ground texture composed in a lattice shape by the warps and the wefts. The arrangement intervals between the weft fascia portions adjacent to each other in the vertical direction are first gradually decreased from one end of the clothing fabric toward the other end thereof in the vertical direction, and then are gradually increased toward the other end from the minimum portion. In other words, the arrangement intervals are gradually decreased as it goes inward from one end or the other end of the clothing fabric in the vertical direction. Accordingly, for example, when the furniture cloth is used as the load support member for chair and the vicinity of the portion in which the arrangement interval between the weft fascia portions is small is formed as the waist portion of the backrest or the seated portion of the seat body, there is no sensation of discomfort such as a difference in the elastic support force between the portion of the ground texture and the portion of the weft fascia portion, and hence the seating comfort may be obtained. Further, when the furniture cloth is applied as the blindfold member for panel, since the portion of the weft fascia portion is formed in a wide area, the blinding effect may be appropriately exhibited.

Further, since the arrangement intervals between the weft fascia portions are first gradually decreased from one end of the clothing fabric toward the other end thereof in the vertical direction by increasing the number of the thick horizontal yarns constituting the weft fascia portion and widening the width of the weft fascia portion, and then are gradually increased toward the other end by decreasing the number of the thick horizontal yarns from the minimum portion and narrowing the width of the weft fascia portion, it is possible to easily form the arrangement shape by the plurality of the weft fascia portions on the surface of the ground texture just by increasing or decreasing the number of times of operations of changing the width of the weft fascia portion during the process of manufacturing the furniture cloth.

Further, since the arrangement intervals between the weft fascia portions are first gradually decreased from one end of the clothing fabric toward the other end thereof in the vertical direction by decreasing the number of grains of the ground texture between the adjacent weft fascia portions, and then are gradually increased toward the other end by increasing the number of grains from the minimum portion, it is possible to easily form the arrangement shape of the plurality of weft fascia portions on the surface of the ground texture just by decreasing or increasing the number of grains of the ground texture in the vertical direction during the process of manufacturing the furniture cloth.

Further, it is possible to easily apply the furniture cloth to even large furniture or the like by continuously repeating the pattern of the arrangement shape formed by the plurality of weft fascia portions at least once or more in the vertical direction of the clothing fabric.

Further, since the chair according to the invention is formed by stretching the furniture cloth over the frame of the backrest or the seat body so that the arrangement intervals between the weft fascia portions are gradually decreased inward from the upper and lower ends of the backrest or the front and rear ends of the seat body, it is possible to obtain a strong elastic support force of the furniture cloth stretched over the backrest or the seat body in a necessary portion without extremely differentiating the elastic support force for each portion with respect to the load of the back or the lower body of the human body of the seater, and hence the seating comfort may be obtained.

Further, since the arrangement intervals between the weft fascia portions are decreased by gradually increasing the number of the thick horizontal yarns constituting the weft fascia portion inward from the upper and lower ends of the backrest or the front and rear ends of the seat body and widening the width of the weft fascia portion, it is possible to easily form the dense weft fascia portion in the upholstery fabric formed by the ground texture.

Further, since the vicinity of the portion where the arrangement interval between the weft fascia portions becomes minimal is formed as the support portion for the waist portion or the seated portion of the seater, it is possible to easily obtain a strong elastic support force in a necessary portion without extremely differentiating the elastic support force for each portion.

Further, since the chair according to the invention has a configuration in which the plurality of strip-shaped step portions extending in the left and right direction so as to protrude from the surface of the upholstery fabric are arranged to be spaced from each other in the longitudinal direction corresponding to the front and rear direction of the seat body or the up and down direction of the backrest, and the arrangement intervals between the adjacent strip-shaped step portions are formed so as to be gradually decreased inward from the upper and lower ends of the backrest or the front and rear ends of the seat body, it is possible to prevent the slippage of the portion between the back or the lower leg and the upholstery fabric.

Further, since the upholstery fabric is formed by the elastic cloth obtained by the clothing fabric of the ground texture which is composed in a lattice shape by the warps and the wefts respectively formed by using the plurality of the vertical yarns or the horizontal yarns respectively formed of any one of the single yarns or the thick twisted yarns, the weft fascia portions wider than the wefts are composed in the ground texture so as to protrude from the surface of the upholstery fabric, and the weft fascia portions are formed as the strip-shaped step portions, it is possible to easily form the strip-shaped step portions during the process of manufacturing the upholstery fabric.

Further, since the arrangement intervals between the strip-shaped step portions are formed so as to be gradually decreased inward from the upper and lower ends of the backrest or the front and rear ends of the seat body by gradually increasing the number of the horizontal yarns respectively formed by the thick twisted yarns forming the weft fascia portions and widening the width of the weft fascia portion, it is possible to easily adjust the arrangement interval between the strip-shaped step portions during the process of manufacturing the upholstery fabric.

Further, since the vicinity of the portion where the arrangement interval between the strip-shaped step portions becomes minimal is formed as the support portion for the waist portion or the seated portion of the seater, it is possible to reliably prevent the slippage of the portion between the back or the lower leg of the human body and the seater.

DESCRIPTION OF EMBODIMENTS

Hereinafter, an embodiment of the invention will be described based on the accompanying drawings.

Figure 1:
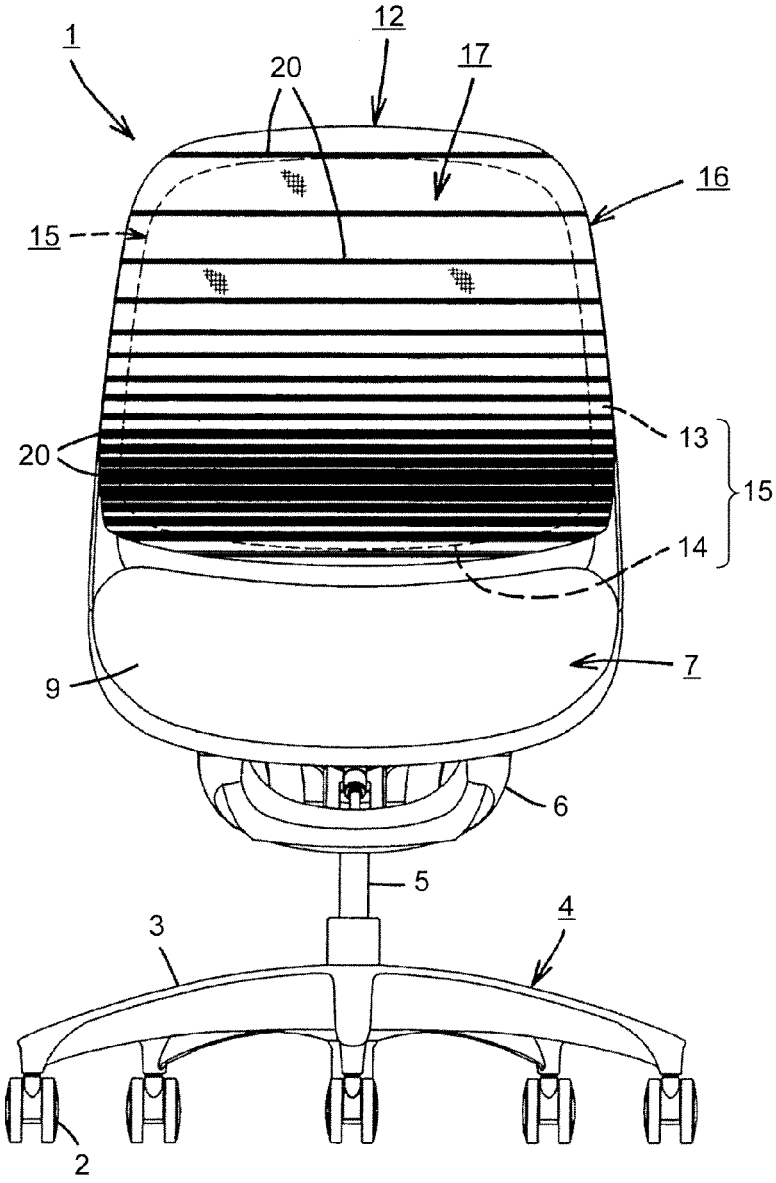
FIG. 1 is a front view illustrating a non-use state of a chair that uses a furniture cloth of an embodiment of the invention in an upholstery fabric of a backrest.
Figure 2:
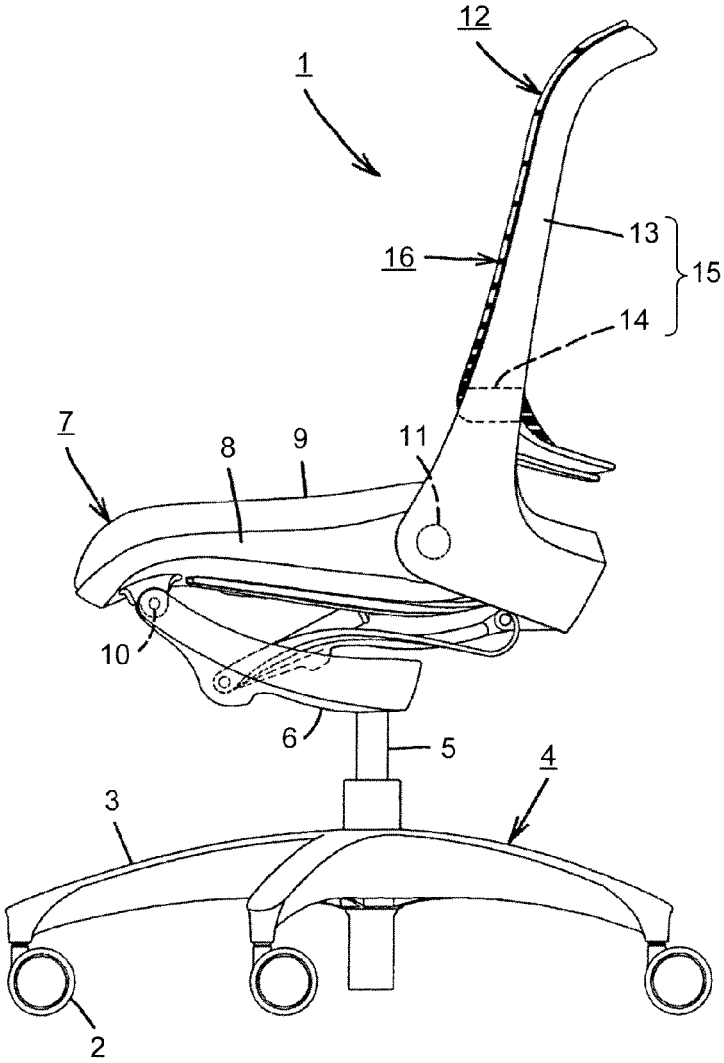
FIG. 2 is a side view illustrating a use state of the chair illustrated in FIG. 1.
Figure 3:
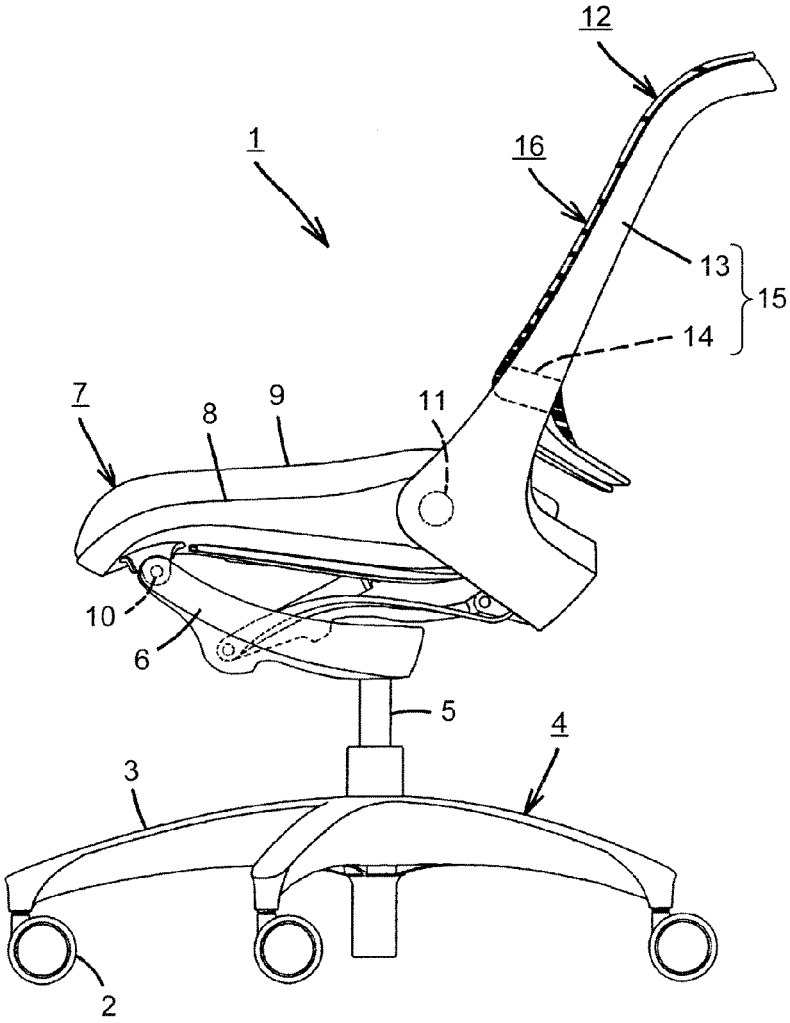
FIG. 3 is a side view illustrating a backward inclined state of the chair illustrated in FIG. 1.

FIG. 1 is a front view of a non-use state of a chair which uses a furniture cloth of an embodiment of the invention in an upholstery fabric of a backrest, FIG. 2 is a side view of the use state thereof, and FIG. 3 is a side view of a backward inclined state thereof.

Embodiment

As illustrated in FIGS. 1 to 3, a chair 1 includes a leg body 4 that has five radial leg rods 3 each of which a distal end is provided with a caster 2. A telescopic leg column 5 having a gas spring (not illustrated) is uprightly formed at the center of the leg body 4, and a rear portion of a support base 6 is fixed to an upper end of the leg column 5. Incidentally, the support base 6, the leg column 5, and the leg body 4 are integrated with each other in some cases.

The support base 6 is formed in a triangular shallow dish shape in the top view spreading forward, and is inclined in the front upper direction in the side view.

A seat body 7 includes a seat plate 8 which is formed of a synthetic resin and a cushion material 9 which is attached to the upper surface thereof. Both front end side portions of the seat plate 8 are pivoted to both front end side portions of the support base 6 by a pivot shaft 10 in the left and right direction, and as illustrated in FIG. 1, the seat body 7 is rotatable about the pivot shaft 10 from a standby state where the seat body is inclined backward and upward to a use position where the seat body is horizontal or inclined backward and downward as illustrated in FIG. 2. Accordingly, the load of the seater is applied to the rear side in relation to the leg column 5, and a hip of a seater may be highly stably supported by the rear portion of the seat body 7.

Both rear end side portions of the seat plate 8 are pivoted to both lower end side portions of a backrest 12 by a shaft 11 in the left and right direction. The backrest 12 is rotatable about the shaft 11 from an upright position where the backrest is substantially upright as illustrated in FIG. 2 to a backward inclined position illustrated in FIG. 3.

As illustrated in FIG. 1, the backrest 12 is formed by stretching a mesh-like upholstery fabric 16 over a rim-shaped frame 15 including a backrest frame 13 which is formed in an inverted U-shape in the front view and an intermediate frame 14 which is laterally laid at the lower side of the intermediate portion of the backrest frame 13 in the up and down direction.

Figure 4:
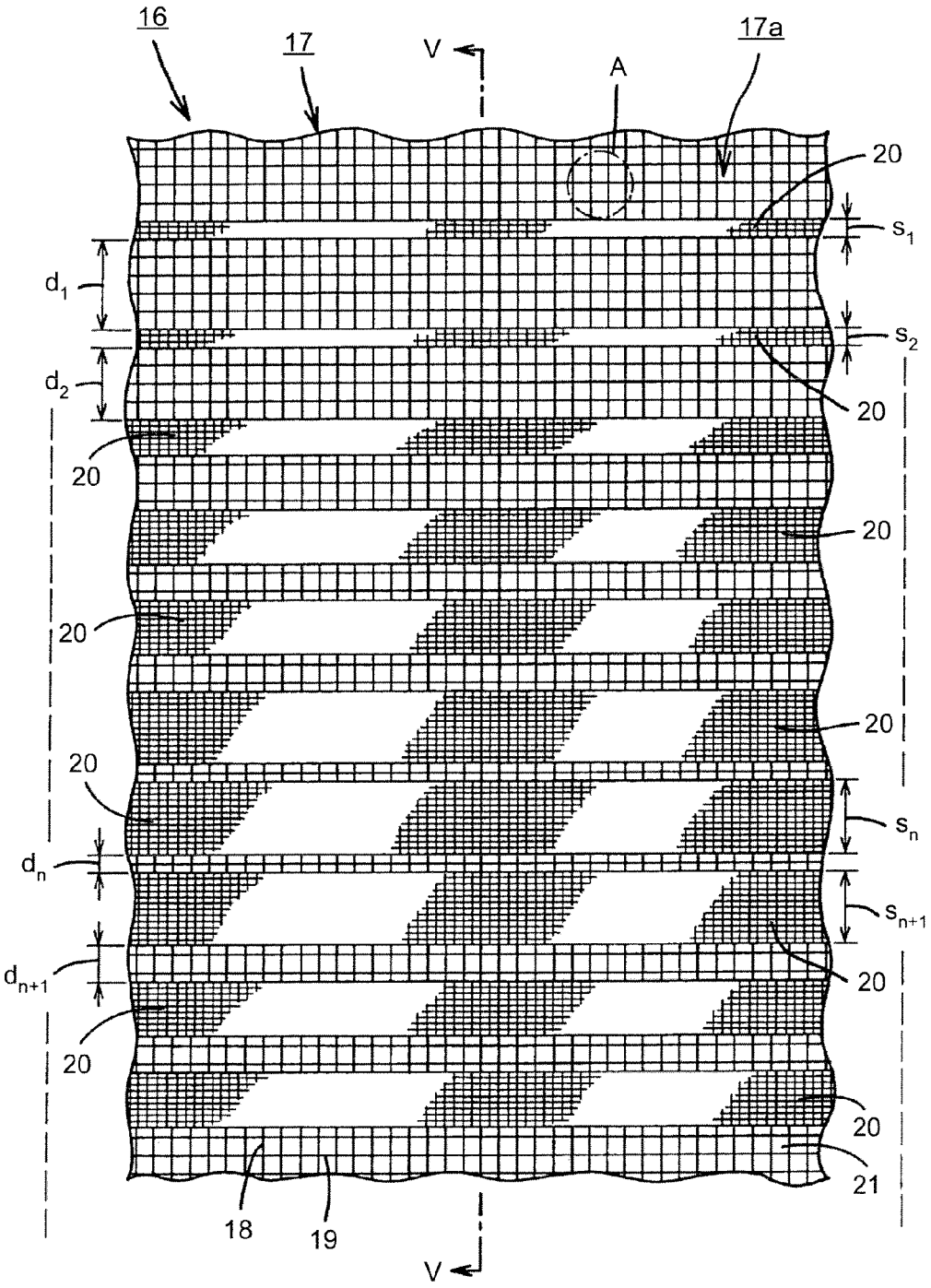
FIG. 4 is a front view illustrating a part of an elastic cloth constituting the upholstery fabric.
Figure 5:
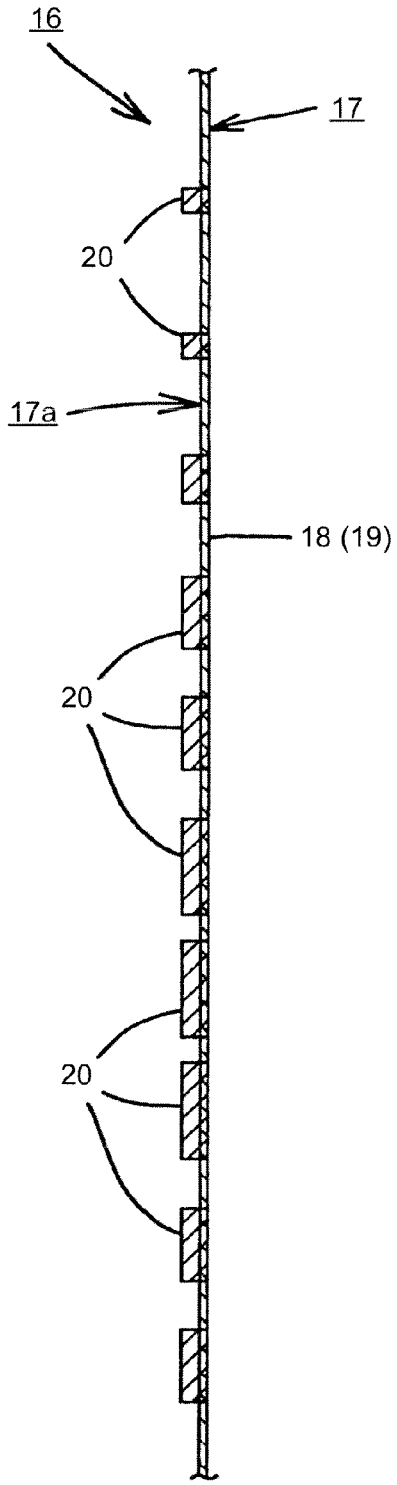
FIG. 5 is a main enlarged longitudinal sectional side view taken along the line V-V of FIG. 4.
Figure 6:
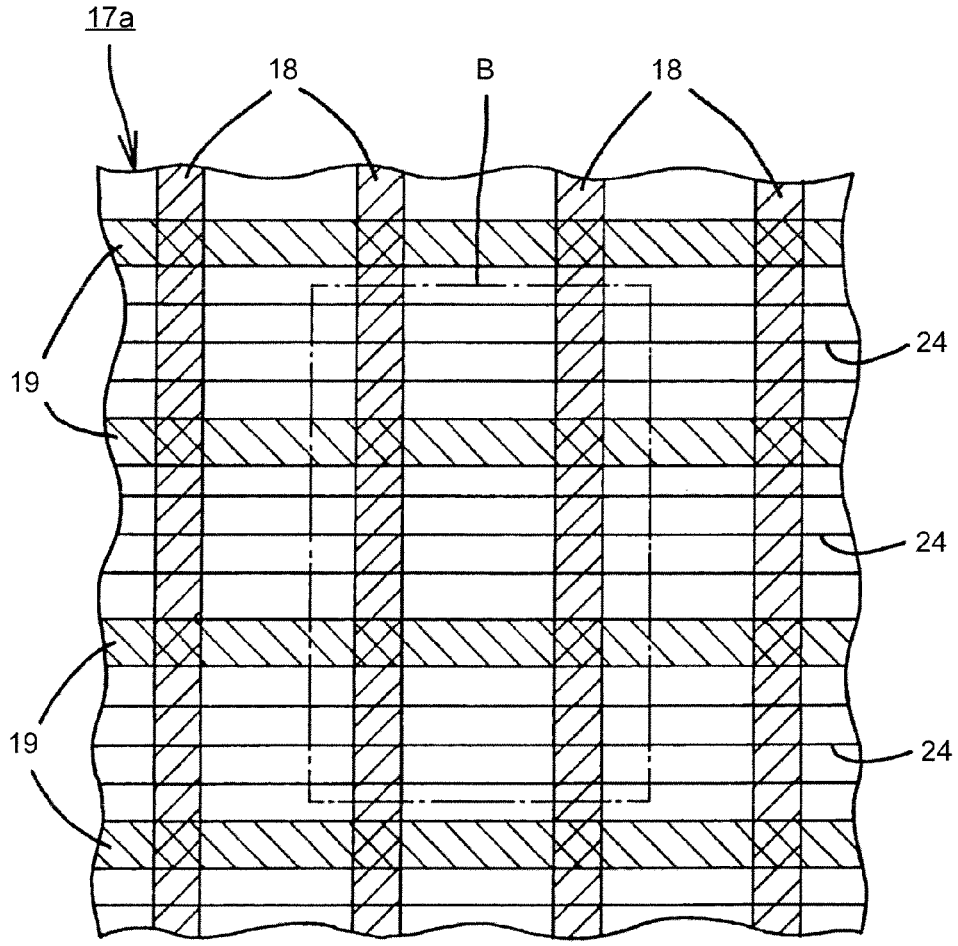
FIG. 6 is a partially enlarged front view of a shape of a grain which is formed by a warp and a weft constituting a ground texture of a clothing fabric of the elastic cloth in a circle A of FIG. 4.
Figure 7:
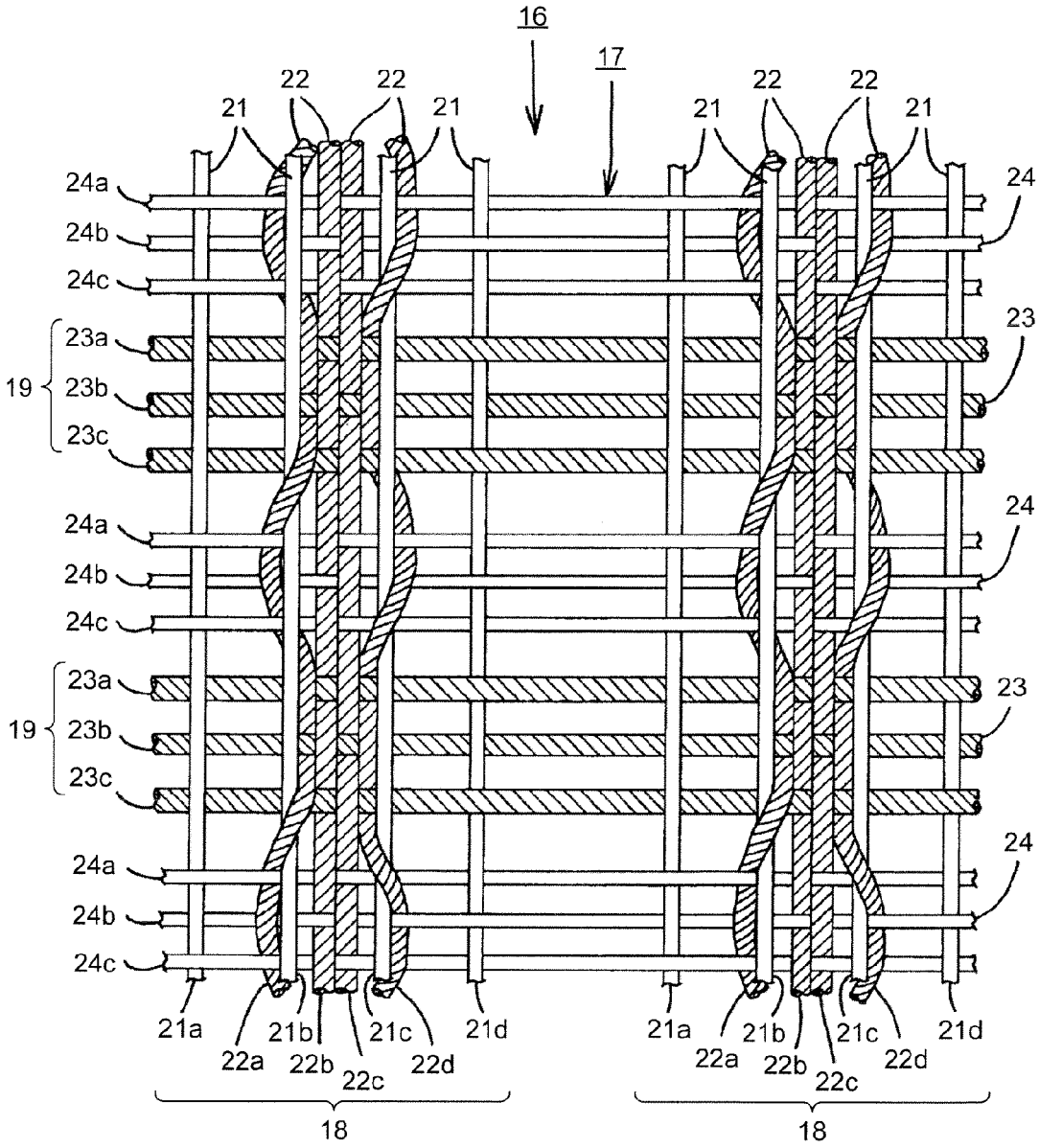
FIG. 7 is a partially enlarged schematic diagram illustrating a composition state of a warp and a weft constituting a ground texture in a square frame B of FIG. 6.

FIG. 4 is a front view illustrating a part of an elastic cloth constituting the upholstery fabric, FIG. 5 is a main enlarged longitudinal sectional side view taken along the line V-V of FIG. 4, FIG. 6 is a partially enlarged front view of a shape of a grain which is formed by a warp and a weft constituting a ground texture of a clothing fabric of an elastic cloth in a circle A of FIG. 4, and FIG. 7 is a partially enlarged schematic diagram illustrating a composition state of a warp and a weft constituting a ground texture in a square frame B of FIG. 6.

As illustrated in FIG. 4, the upholstery fabric 16 is formed by an elastic cloth 17 in which a ground texture 17*a* is composed in a lattice shape by warps 18 and wefts 19.

The warps 18 and the wefts 19 are composed in a lattice shape at the substantially same width, so that the ground texture 17*a* has a uniform grain. When composing the warps 18 and the wefts 19 in a lattice shape as illustrated in FIG. 6, for example, when compositing the warps 18 each having a width of 2 mm and the wefts 19 each having a width of 2 mm at the interval of 2 mm in a lattice shape, the ground texture 17*a* has a shape in which a uniform square grain of 2 mm is formed at the center of each lattice in the vertical and horizontal directions.

As illustrated in FIGS. 1 and 4, the wefts 19 which extend in the left and right direction is provided with a weft fascia portion 20 which is wider than the weft 19 in the vertical direction, i.e., the up and down direction of the backrest 12 and extends in the horizontal direction, i.e., the left and right direction of the backrest 12. The weft fascia portion 20 is formed so as to be denser than the ground texture 17*a*.

A plurality of the weft fascia portions 20 are arranged while being separated from each other in the vertical direction of the clothing fabric. The arrangement intervals d1, d2 . . . dn between the weft fascia portions 20 adjacent to each other in the vertical yarn direction first gradually becomes smaller as it goes downward from the upper end of the backrest 12 or as it goes toward a position corresponding to the waist portion of the seater at the substantially rear center portion from the front end of the seat body 7, and then the arrangement intervals dn, dn+1 . . . gradually becomes larger from the portion of the minimum interval dn. In other words, the arrangement interval between the weft fascia portions 20 becomes smaller inward from the upper and lower ends of the backrest 12. Further, the weft fascia portions 20 protrude from the surface of the ground texture 17*a* as illustrated in FIG. 5, thereby forming a shape in which the plurality of weft fascia portions 20 are arranged on the surface of the ground texture 17*a* (hereinafter, referred to as a lateral step-shape).

The lateral step-shaped patterns may be repeatedly and continuously formed at least once or more in the vertical direction of the clothing fabric so as to match the size of the backrest 12 of the adopted chair. By the arrangement of the plurality of weft fascia portions 20, the back of the seater may be stably supported.

Incidentally, when forming the weft fascia portions 20, single yarns 21 and thick twisted yarns 23 are combined with each other in the composition of the wefts 19 in the ground texture 17*a* to be described later, thereby composing a ribbed fabric texture in which the thick twisted yarns 23 protrude from the surface of the ground texture 17*a* in a rib shape. Accordingly, the weft fascia portion 20 may protrude from the surface of the ground texture 17*a* with a step as a strip-shaped step portion.

That is, in order to compose the ground texture 17*a* of the clothing fabric, as illustrated in FIG. 7, the warps 18 are formed by the plurality of single yarns 21, for example, four thin warps 21*a* to 21*d* and the plurality of thick twisted yarns 22, for example, four thick warps 22*a* to 22*d*, and two of the thin warps 21*a* to 21*d* are disposed at each of both sides of the thick warps 22*a* to 22*d*.

On the other hand, the weft 19 is formed by a plurality of thick twisted yarns 23, for example, three thick horizontal yarns 23*a* to 23*c*.

Further, in a lattice gap which becomes a grain between the wefts 19 adjacent to each other in the vertical direction, a plurality of single yarns 24, for example, three transparent thin horizontal yarns 24*a* to 24*c* are arranged as reinforcing yarns.

Next, a composition state of the ground texture 17*a* in the clothing fabric will be described.

Regarding the thin warp 21*a* which is disposed at the outside of one side among the four thin warps 21*a* to 21*d* constituting the warp 18, the three thin horizontal yarns 24*a* to 24*c* are woven in a plain fabric state at a position spaced from the three thick horizontal yarns 23*a* to 23*c*.

Regarding the thin warp 21*d* which is disposed at the outside of the other side, the three thin horizontal yarns 24*a* to 24*c* and the three thick horizontal yarns 23*a* to 23*c* are woven in a plain fabric state.

Regarding the four thick warps 22*a* to 22*d* constituting the warp 18, the three thin horizontal yarns 24*a* to 24*c* and the three thick horizontal yarns 23*a* to 23*c* are alternately woven in a plain fabric state, and the two thick warps 22*a* and 22*d* at the outside in the four thick warps 22*a* to 22*d* are tangled and woven to the two thin warps 21*b* and 21*d* in the four thin warps 21*a* to 21*d* in a woven state. Accordingly, the ground texture 17*a* of the clothing fabric is composed in a lattice shape by the warps 18 and the wefts 19. The warps and the wefts are woven so as to reliably maintain the lattice shape without shifting the warps 18 in the horizontal direction and shifting the wefts 19 in the vertical direction after composition.

In order to form the wefts 19 constituting the ground texture 17*a* of the clothing fabric of the upholstery fabric 16 described above in the weft fascia portion 20 partially protruding from the surface of the ground texture 17*a*, for example, the thick horizontal yarns 23*a*, 23*b*, and 23*c* are respectively overlapped at two positions on both sides in the vertical direction of the weft 19 illustrated in FIG. 7, and the thick horizontal yarns 23*a*, 23*b*, and 23*c* are inserted while supplementing the thin horizontal yarns 24*a*, 24*b*, and 24*c* which become the reinforcing yarns if necessary during the process of weaving the weft 19, thereby composing the ribbed fabric texture together with the thick horizontal yarns 23*a*, 23*b*, and 23*c* constituting the weft 19.

Further, in order to gradually decrease the arrangement intervals d1, d2 . . . dn between the weft fascia portions 20 which are adjacent to each other in the vertical direction as it goes from the upper end of the backrest 12 toward the position corresponding to the waist portion of the seater at the substantially lower center portion, the widths s1, s2 . . . sn, sn+1 of the respective weft fascia portions 20 are adjusted so as to partially increase the number of the thick horizontal yarns

23*a*, 23*b*, and 23*c* and to gradually decrease the number of grains between the weft fascia portions 20 in the vertical direction.

Furthermore, in order to gradually increase the arrangement intervals dn, dn+1 . . . between the weft fascia portions 20 from the portion where the arrangement interval between the weft fascia portions 20 is the minimum dn and the width of the weft fascia portion 20 is the maximum width sn, the number of the thick horizontal yarns 23*a*, 23*b*, and 23*c* is partially decreased and the number of grains of the ground texture 17*a* between the weft fascia portions 20 in the vertical direction is gradually increased.

In this case, for example, in the portion in which the arrangement intervals d1 and d2 between the weft fascia portions 20 are wide and the widths s1 and s2 of the weft fascia portions 20 are narrow and substantially equal to each other as in the upper portion of the backrest 12, the arrangement interval between the weft fascia portions 20 may be partially and gradually decreased by decreasing only the number of grains in the vertical direction of the ground texture 17*a* between the weft fascia portions 20 which are adjacent to each other in the vertical direction.

Incidentally, in the above-described embodiment, an example of the upholstery fabric which is stretched over the backrest of the chair has been described, but the invention may be also applied to a blindfold member of large furniture such as a large panel or to an upholstery fabric stretched over a seat body or the like.

In the case of the seat body, the arrangement intervals d1, d2 . . . dn between the respective weft fascia portions 20 which are formed in a lateral step-shape are arranged so as to be first gradually decreased as it goes from the front end of the seat body toward a portion corresponding to the seated portion of the seater of the substantially rear center portion, and then the arrangement intervals dn, dn+1 . . . are arranged so as to be gradually increased. In other words, the arrangement intervals between the weft fascia portion 20 are arranged so as to be decreased from the front and rear ends of the seat body toward the inside corresponding to the seated portion of the seater at the substantial center portion, thereby stably supporting the seated portion of the seater.

Further, in the case of the blindfold member of large furniture, the blindfold member may be easily adopted by continuously repeating the lateral step-shape at least several times in the vertical direction of the clothing fabric so as to match the size, and hence the blinding effect may be appropriately exhibited.

REFERENCE SIGNS LIST

1 CHAIR
2 CASTER
3 LEG ROD
4 LEG BODY
5 LEG COLUMN
6 SUPPORT BASE
7 SEAT BODY
8 SEAT PLATE
9 CUSHION MATERIAL
10 PIVOT SHAFT
11 SHAFT
12 BACKREST
13 BACKREST FRAME
14 INTERMEDIATE FRAME
15 RIM-SHAPED FRAME
16 UPHOLSTERY FABRIC
17 ELASTIC CLOTH
17A GROUND TEXTURE
18 WARP
19 WEFT
20 WEFT FASCIA PORTION (STRIP-SHAPED STEP PORTION)
21 SINGLE YARN
21*a* to 21*d* THIN WARP
22 THICK TWISTED YARN
22*a* to 22*d* THICK WARP
23 THICK TWISTED YARN
23*a* to 23*c* THICK HORIZONTAL YARN
24 SINGLE YARN
24*a* to 24*c* THIN HORIZONTAL YARN

The invention claimed is:

1. A furniture cloth that is formed by a clothing fabric, the furniture cloth comprising:

a ground texture composed in a lattice shape, the ground texture including:

warps formed by a plurality of vertical yarns formed of at least one of single yarns and thick twisted yarns, and wefts formed by a plurality of horizontal yarns formed of at least one of single yarns and thick twisted yarns; and a plurality of weft fascia portions wider than the wefts arranged in the ground texture so as to be spaced from each other from one end of the clothing fabric toward the other end in the vertical direction, the arrangement intervals between the weft fascia portions adjacent to each other in the vertical direction being first gradually decreased from one end of the clothing fabric toward the other end in the vertical direction and then are gradually increased from a minimum portion toward the other end.

2. The furniture cloth according to claim 1, wherein the arrangement intervals between the weft fascia portions are first gradually decreased as it goes from one end of the clothing fabric toward the other end in the vertical direction by increasing the number of the thick horizontal yarns constituting the weft fascia portion and widening the width of the weft fascia portion, and then are gradually increased by decreasing the number of the thick horizontal yarns from the minimum portion and narrowing the width of the weft fascia portion.

3. The furniture cloth according to claim 1, wherein the arrangement intervals between the weft fascia portions are first gradually decreased from one end of the clothing fabric toward the other end in the vertical direction by decreasing grains of the ground texture between the adjacent weft fascia portions, and then are gradually increased toward the other end by increasing the number of grains from the minimum portion.

4. The furniture cloth according to claim 1, wherein a pattern of an arrangement shape formed by the plurality of weft fascia portions is continuously repeated at least once or more in the vertical direction of the clothing fabric.

5. A chair which is formed by stretching the furniture cloth according to claim 1 as an upholstery fabric over a rim-shaped frame in a backrest or a seat body.

6. The chair according to claim 5,wherein the furniture cloth is stretched over the frame of the backrest or the seat body so that the arrangement intervals between the weft fascia portions are gradually decreased as it goes inward from the upper and lower ends of the backrest or the front and rear ends of the seat body.

7. The chair according to claim 6, wherein the arrangement intervals between the weft fascia portions are decreased by gradually increasing the number of the thick horizontal yarns constituting the weft fascia portion as it goes inward from the upper and lower ends of the backrest or the front end rear ends of the seat body and widening the width of the weft fascia portion.

8. The chair according to claim 6, wherein the vicinity of a portion where the arrangement interval between the weft fascia portions becomes minimal is formed as a support portion for a waist portion or a seated portion of a seater.

9. A chair comprising:

a seat body including a rim-shaped frame;

a backrest including a rim shaped frame;

an upholstery fabric stretched over the rim-shaped frame of the seat body of the backrest; and a plurality of strip-shaped step portions extending in the left and right direction so as to protrude from a surface of the upholstery fabric, and arranged so as to be spaced from each other in the longitudinal direction corresponding to the front and rear direction of the seat body or the up and down direction of the backrest, and the arrangement intervals between the adjacent strip-shaped step portions being formed so as to be gradually decreased as it goes inward from the upper and lower ends of the backrest or the front and rear ends of the seat body.

10. The chair according to claim 9, wherein the upholstery fabric is formed by an elastic cloth obtained from a clothing fabric of a ground texture which is composed in a lattice shape by warps and wefts respectively formed by a plurality of vertical yarns or horizontal yarns having at least one of single yarns or thick twisted yarns, and weft fascia portions wider than the wefts are composed in the ground texture so as to protrude from a surface of the upholstery fabric, thereby forming strip-shaped step portions with the weft fascia portions.

11. The chair according to claim 9, wherein the arrangement intervals between the strip-shaped step portions are gradually decreased as it goes inward from the upper and lower ends of the backrest or the front and rear ends of the seat body by gradually increasing the number of thick horizontal yarns constituting the weft fascia portions and widening the width of the weft fascia portion.

12. The chair according to claim 9, wherein the vicinity of a portion where the arrangement interval between the strip-shaped step portions becomes minimal is formed as a support portion for a waist portion or a seated portion of a seater.

* * * * *